US010524064B2

(12) United States Patent
Andersen

(10) Patent No.: US 10,524,064 B2
(45) Date of Patent: Dec. 31, 2019

(54) METHOD AND HEARING ASSISTIVE DEVICE FOR HANDLING STREAMED AUDIO

(71) Applicant: Widex A/S, Lynge (DK)

(72) Inventor: Svend Vitting Andersen, Espergarde (DK)

(73) Assignee: Widex A/S, Lynge (DK)

( * ) Notice: Subject to any disclaimer, the term of this patent is extended or adjusted under 35 U.S.C. 154(b) by 0 days.

(21) Appl. No.: 16/083,078

(22) PCT Filed: Mar. 11, 2016

(86) PCT No.: PCT/EP2016/055288
§ 371 (c)(1),
(2) Date: Sep. 7, 2018

(87) PCT Pub. No.: WO2017/152992
PCT Pub. Date: Sep. 14, 2017

(65) Prior Publication Data
US 2019/0069100 A1 Feb. 28, 2019

(51) Int. Cl.
*H04R 25/00* (2006.01)

(52) U.S. Cl.
CPC ..... *H04R 25/554* (2013.01); *H04R 25/505* (2013.01); *H04R 25/70* (2013.01)

(58) Field of Classification Search
CPC ..... H04R 25/50; H04R 25/505; H04R 25/55; H04R 25/554; H04R 2225/41; H04R 2225/55
See application file for complete search history.

(56) References Cited

U.S. PATENT DOCUMENTS 5,970,795 A 10/1999 Seidmann et al.
6,507,650 B1 1/2003 Moquin
(Continued)

FOREIGN PATENT DOCUMENTS

EP 1 139 213 A2 10/2001
EP 1 674 059 A1 6/2006
(Continued)

OTHER PUBLICATIONS

Patricia A. Niquette, AuD, "Noise Exposure: Explanation of OSHA and NIOSH Safe-Exposure Limits and the Importance of Noise Dosimetry," Etymotic Research Inc., Jun. 2014, 8 pages, vol. 9, No. 3.

(Continued)

*Primary Examiner* — Joshua Kaufman
(74) *Attorney, Agent, or Firm* — Sughrue Mion, PLLC

(57) ABSTRACT

A hearing assistive device has an input transducer (12) converting sound into an audio signal applied to a processor (14; 65). The processor (14; 65) is configured to compensate a hearing loss of a user of the hearing assistive device and to output a compensated audio signal. An output transducer (16; 65) converts the compensated audio signal into sound. The hearing assistive device (10) further comprises a wireless transceiver (21) enabling audio streaming from an external device (30) to the hearing assistive device, an attenuator (23) associated with said processor (14; 65) applying attenuation to the compensated audio signal, and an audio stream analyzer (22*a*) classifying the audio stream received via said wireless transceiver. The attenuator (23) is controlled in accordance to the audio stream classification from the audio stream analyzer (22*a*). The invention further provides a method of operating a hearing assistive device.

13 Claims, 2 Drawing Sheets

(56) References Cited

U.S. PATENT DOCUMENTS

| | | | | |
|---|---|---|---|---|
| 6,661,901 | B1 | 12/2003 | Svean et al. | |
| 8,189,830 | B2 | 5/2012 | Hou | |
| 9,456,264 | B2 * | 9/2016 | Glover | H03G 7/002 |
| 9,503,829 | B2 * | 11/2016 | Baskaran | H04R 29/001 |
| 2002/0080979 | A1 | 6/2002 | Brimhall et al. | |
| 2003/0191609 | A1 | 10/2003 | Bernardi et al. | |
| 2006/0140425 | A1 | 6/2006 | Berg et al. | |
| 2007/0186656 | A1 | 8/2007 | Goldberg et al. | |
| 2007/0214893 | A1 * | 9/2007 | Killion | G01H 3/14 73/648 |
| 2008/0013744 | A1 | 1/2008 | Von Dach et al. | |
| 2008/0037797 | A1 | 2/2008 | Goldstein et al. | |
| 2008/0137873 | A1 | 6/2008 | Goldstein | |
| 2008/0159547 | A1 | 7/2008 | Schuler et al. | |
| 2008/0181424 | A1 * | 7/2008 | Schulein | H03G 7/002 381/74 |
| 2008/0181442 | A1 | 7/2008 | Goldstein et al. | |
| 2008/0205660 | A1 * | 8/2008 | Goldstein | A61B 5/0002 381/60 |
| 2008/0240458 | A1 * | 10/2008 | Goldstein | H04R 25/453 381/72 |
| 2009/0071486 | A1 | 3/2009 | Perez et al. | |
| 2009/0220096 | A1 | 9/2009 | Usher et al. | |
| 2010/0196861 | A1 * | 8/2010 | Lunner | H04R 25/505 434/112 |
| 2010/0278350 | A1 | 11/2010 | Rung | |
| 2012/0275628 | A1 * | 11/2012 | Pedersen | H04R 25/554 381/313 |
| 2013/0039518 | A1 | 2/2013 | Goldstein et al. | |
| 2013/0094658 | A1 | 4/2013 | Holter | |
| 2013/0101128 | A1 * | 4/2013 | Lunner | H04R 25/30 381/60 |
| 2015/0092948 | A1 | 4/2015 | Usher et al. | |
| 2015/0350794 | A1 * | 12/2015 | Pontoppidan | H04R 25/00 381/321 |

FOREIGN PATENT DOCUMENTS

| | | | |
|---|---|---|---|
| EP | 2 127 074 | A1 | 12/2009 |
| EP | 2 127 467 | A2 | 12/2009 |
| EP | 2 194 366 | A1 | 6/2010 |
| WO | 2007/082579 | A2 | 7/2007 |
| WO | 2008/093954 | A1 | 8/2008 |
| WO | 2009/012491 | A2 | 1/2009 |
| WO | 2011/027004 | A2 | 3/2011 |
| WO | 2011/159349 | A1 | 12/2011 |
| WO | 2015/119783 | A1 | 8/2015 |

OTHER PUBLICATIONS

Written Opinion of the International Searching Authority of PCT/EP2016/055288 dated Dec. 5, 2016.

International Search Report of PCT/EP2016/055288 dated Dec. 5, 2016.

* cited by examiner

METHOD AND HEARING ASSISTIVE DEVICE FOR HANDLING STREAMED AUDIO

CROSS REFERENCE TO RELATED APPLICATIONS

This application is a National Stage of International Application No. PCT/EP2016/055288 filed Mar. 11, 2016.

BACKGROUND OF THE INVENTION

Field of the Invention

The present invention relates to hearing assistive devices. The invention, more particularly, relates to a method for handling streamed audio in a hearing assistive device.

Description of Related Art

Hearing aids have so far been stand-alone devices having an input transducer converting sound from the acoustic environment into an audio signal applied to a processor compensating for the hearing loss of a user, and an output transducer converting the compensated audio signal into sound. In addition to the sound picked up by the microphone, hearing aids have for decades been able to handle audio signals received from external devices via a tele-coil. Receiving audio signals from television and phone calls in hearing aids via proprietary protocols has also been common for several years. European Hearing Instrument Manufacturers Association (EHIMA) is currently involved in developing a new Bluetooth standard for hearing aids, including improving existing features, and creating new ones such as stereo audio from a mobile device or media gateway with Bluetooth wireless technology. From being devices assisting hearing impaired in dialogue with other persons, hearing assistive devices are expected to also offer entertainment audio in the future.

The purpose of the invention is to provide a hearing assistive device offering audio from various external devices, while protecting the hearing of the user of the hearing assistive device.

SUMMARY OF THE INVENTION

The invention, in a first aspect, provides a hearing assistive device having an input transducer converting sound into an audio signal applied to a processor, the processor is configured to compensate a hearing loss of a user of the hearing assistive device and to output a compensated audio signal, and an output transducer converting the compensated audio signal into sound. The hearing assistive device further comprises a wireless transceiver enabling audio streaming from an external device to the hearing assistive device, a sound dosimeter measuring during audio streaming a parameter representative a sound level of the compensated audio signal output by the output transducer, and an attenuator associated with said processor applying attenuation to the compensated audio signal. The attenuator is controlled according to the parameter measured by the sound dosimeter.

Preferably, the sound dosimeter is enabled during the audio streaming from said external device. The audio stream analyzer or channel decoder classifies the audio stream received as utility audio or entertainment audio, and preferably the sound dosimeter is enabled when the audio stream is classified as entertainment audio.

In one embodiment of the invention, the output from the sound dosimeter is compared with one or more predefined thresholds, and the attenuation applied to the compensated audio signal depends on this comparison.

In one embodiment of the invention, the audio stream is received as packet data, and the audio stream analyzer classifies the data stream as utility audio or entertainment audio based upon the header of the data packets.

According to a second aspect of the invention there is provided a method of operating a hearing assistive device having an input transducer converting sound into an audio signal applied to a processor, the processor being configured to compensate a hearing loss of a user of the hearing assistive device and to output a compensated audio signal, and an output transducer converting the compensated audio signal into sound. The method further comprises receiving an audio stream from an external device, measuring during audio streaming a parameter representing a sound level output by the output transducer, applying attenuation to the compensated audio signal, and controlling said attenuation according to the measured parameter.

BRIEF DESCRIPTION OF THE DRAWINGS

The invention will be described in further detail with reference to preferred aspects and the accompanying drawing, in which.

DETAILED DESCRIPTION

The current invention relates to a hearing assistive device that is adapted to at least partly fit into the ear and amplify sound. Hearing assistive devices include Personal Sound Amplification Products and hearing aids. Both Personal Sound Amplification Products (PSAP) and hearing aids are small electroacoustic devices which are designed to amplify sound for the wearer. Personal Sound Amplification Products are mostly off-the-shelf amplifiers for people with normal hearing who need a little boost in volume in certain settings (such as hunting and bird watching). A hearing aid aims to making speech more intelligible, and to correct impaired hearing as measured by audiometry. In the United States, hearing aids are considered medical devices and are regulated by the Food and Drug Administration (FDA).

Figure 1:
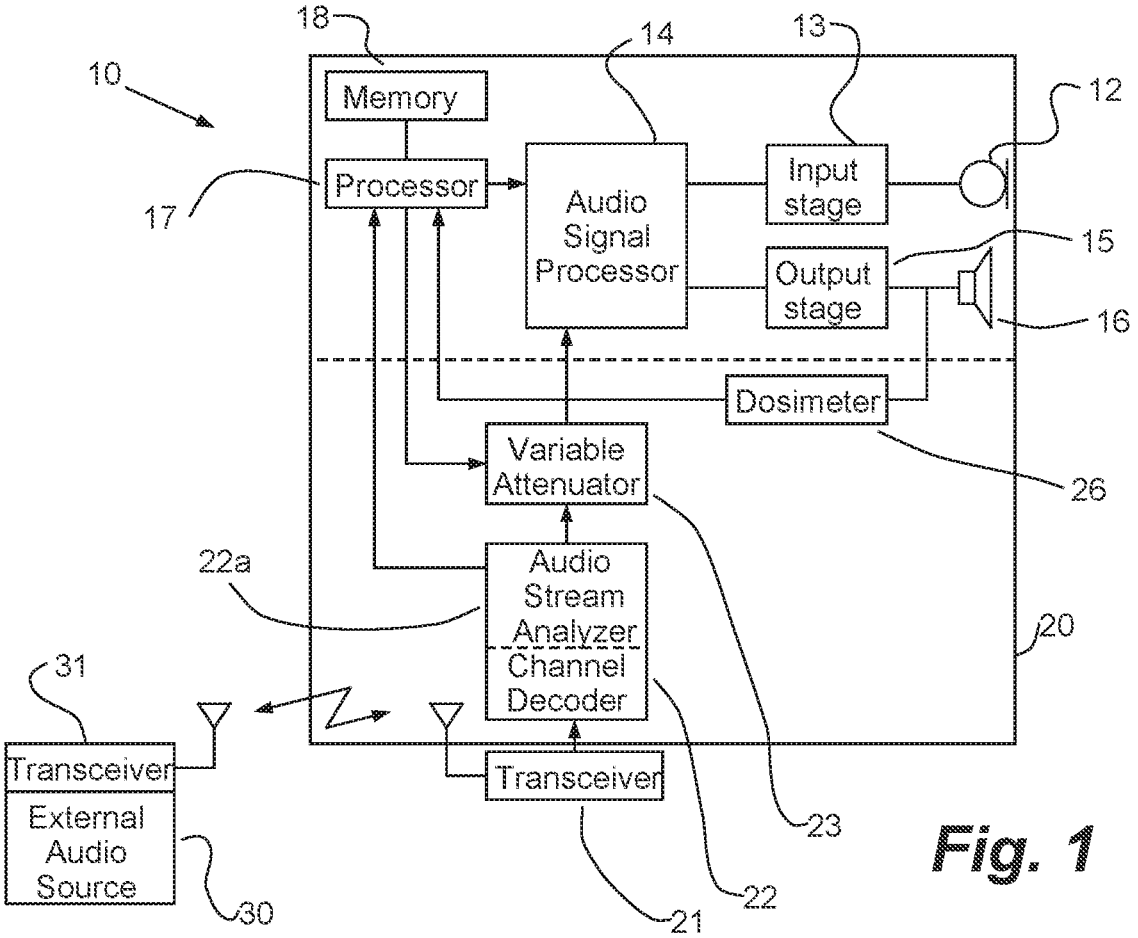
FIG. 1 illustrates schematically a first embodiment of a hearing assistive device according to the invention.

Reference is made to FIG. 1, which schematically illustrates a first embodiment of a hearing assistive device according to the invention. The hearing assistive device according to the embodiment shown in FIG. 1 is a hearing aid 10. Hearing aids are often provided to a hearing impaired user as a set of binaural hearing aids 1. The set of hearing aids 1 have preferably an inter-ear communication channel based on a suitable communication protocol, such as the Bluetooth™ Low Energy protocol. It is foreseen that the preferred communication protocol will continue to evolve and that the currently preferred Bluetooth™ Low Energy protocol will become amended towards the IEEE 802.11x specification family. However the invention is applicable for any type of hearing aid 10 being able to receive a streamed audio signal from an external device 30 via a wireless connection. The hearing aid 10 according to the illustrated embodiment comprises traditional hearing aid elements with settings controlled by a hearing care professional or audiologist, and streaming related elements 20 being present in the lower part of the hearing aid 10 separated by a dotted line.

The hearing aid 10 comprises an input transducer 12 or microphone for picking up the acoustic sound and converting it into electric signals. The electric signals from the input transducer 12 are amplified and converted into a digital signal in an input stage 13. The digital signal is fed to a Digital Signal Processor (DSP) or audio signal processor 14 being a specialized microprocessor with its architecture optimized for the operational needs of the digital signal processing task, i.e. for carrying out the amplification and conditioning according to a predetermined setting in order to alleviate a hearing loss by amplifying sound at frequencies in those parts of the audible frequency range where the user suffers a hearing deficit. The output from the audio signal processor 14 is fed to an output stage 15 for reproduction by an output transducer 16 or speaker. The output stage 15 may apply Delta-Sigma-conversion to the digital signal for forming a one-bit digital data stream fed directly to the output transducer 16, the output stage thereby operating as a class D amplifier.

The hearing aid 10 has a processor 17 being a processing and control unit carrying out instructions of a computer program by performing the logical, basic arithmetic, control and input/output (I/O) operations specified by the instruction in the programs. The processor 17 is further connected to a non-volatile memory 18 which retains stored information even when not powered. Furthermore, the hearing aid 1 has a transceiver 21 for establishing a wireless connection with a remote device 30 having a transceiver 31 appropriate for communication with the hearing aid 10.

The external audio signal source 30 prepares the audio stream for transmission via a transmitter 31, and the preparation includes advertising the type of data. When the external audio signal source 30 is a smartphone, the advertising data packet may specify that the subsequent data packets contain an audio stream originating from a phone call (utility audio) or from a music player or is a soundtrack from Internet video streaming (both entertainment audio). When the external audio signal source 30 is a public communication device adapted for broadcasting an audio signal, the external audio signal source 30 advertises the audio stream as entertainment audio. Alarm and emergency notifications will always be advertised as utility audio in order to become reproduced in the hearing aid 10 as loud as possible.

When the hearing aid 10, receives the signal from the external audio signal source 30, the transceiver 21 receives a radio signal and converts the information carried therein to a usable data signal fed to a channel decoder 22. The channel decoder 22 includes an audio stream analyzer 22*a*. The channel decoder 22 receives and decodes the data packets received and the audio stream analyzer 22*a* extracts advertising information contained in the data signal and classifies the payload of the data signal according to this extraction. This classification of received data signals may include utility audio signals, primary formed by audio from telephone calls, and entertainment audio signals including streamed music from music players, and soundtracks from streamed video and television broadcasts. Furthermore, the data signal may contain hearing aid programming instructions as payload. Hearing aid programming includes two different aspects; acoustic programming referring to setting parameters (e.g. gain and frequency response) affecting the sound output to the user; and operational programming referring to settings which do not affect the sound significantly, such as volume control and selection of environmental programs. The type of programming may be determined based on the advertising information contained in the data signal. The classification of the received data signal is communicated to the processor 17.

In case the received data signal is classified as a utility audio signal by the audio stream analyzer 22*a*, the processor 17 controls a variable attenuator 23 to pass the received audio signal un-attenuated on towards the audio signal processor 14 amplifying and conditioning the received data signal according to the predetermined setting in order to alleviate the hearing loss.

The National Institute for Occupational Safety and Health (NIOSH) is part of the Centers for Disease Control and Prevention (CDC) within the U.S. Department of Health and Human Services, and they are responsible for conducting research and making recommendations for the prevention of work-related injury and illness. NIOSH has made recommendations for a Recommended Exposure Limit for the "consumed" environmental audio. NIOSH recommends an exposure limit of 85 dBA for 8 hours per day, and uses a 3 dB time-intensity tradeoff, i.e. every 3 dB increase or decrease in noise level will reduce by half or double the recommended exposure time. The Occupational Safety and Health Administration (OSHA) is part of the U.S. Department of Labor and have developed a standard (29CFR1910.95) permitting exposures of 85 dBA for 16 hours per day, and uses a 5 dB time-intensity tradeoff.

In case the received data signal is classified as an entertainment audio signal by the audio stream analyzer 22*a*, the processor 17 controls a variable attenuator 23 adapted to attenuate the received audio signal before passing it on towards the audio signal processor 14. The attenuation ensures that the playing of entertainment audio signals does not adversely affect the hearing capabilities of the hearing aid user. The attenuation may be applied in increments of e.g. 3 dB. The purpose of the attenuation is to ensure that the entertainment audio signal is attenuated to a level complying with the health authorities recommendations.

The purpose of a hearing aid is to amplify sounds and make them intelligible for the hearing aid user, and the employment of the variable attenuator 23 is to ensure that the hearing aid user's hearing capabilities are not adversely affected due to long-term exposure to entertainment audio. For this purpose, a sound dosimeter 26 estimates the output from the speaker 16 in the hearing aid user's ear channel through monitoring the signal processor output signal, calculating the equivalent sound pressure level in the ear canal and integrating the level over time according to accepted rules about assessment of long-term noise exposure. The sound dosimeter 26 monitors the accumulated exposure over time and the processor 17 compares the measured exposure to an exposure limit and adjusts the variable attenuator 23 in order to ensure that the measured exposure does not exceed the exposure limit. The processor 17 applies a 3 dB time-intensity tradeoff for long term exposure that may occur e.g. when watching television.

In a further embodiment, only audio signals from remote microphones and audio from telephone conversation is marked by the transmitter. Then marked audio signals are classified by the audio stream analyzer 22*a* and handled as utility audio signals, while unmarked audio signals are classified and handled as entertainment audio signals.

Figure 2:
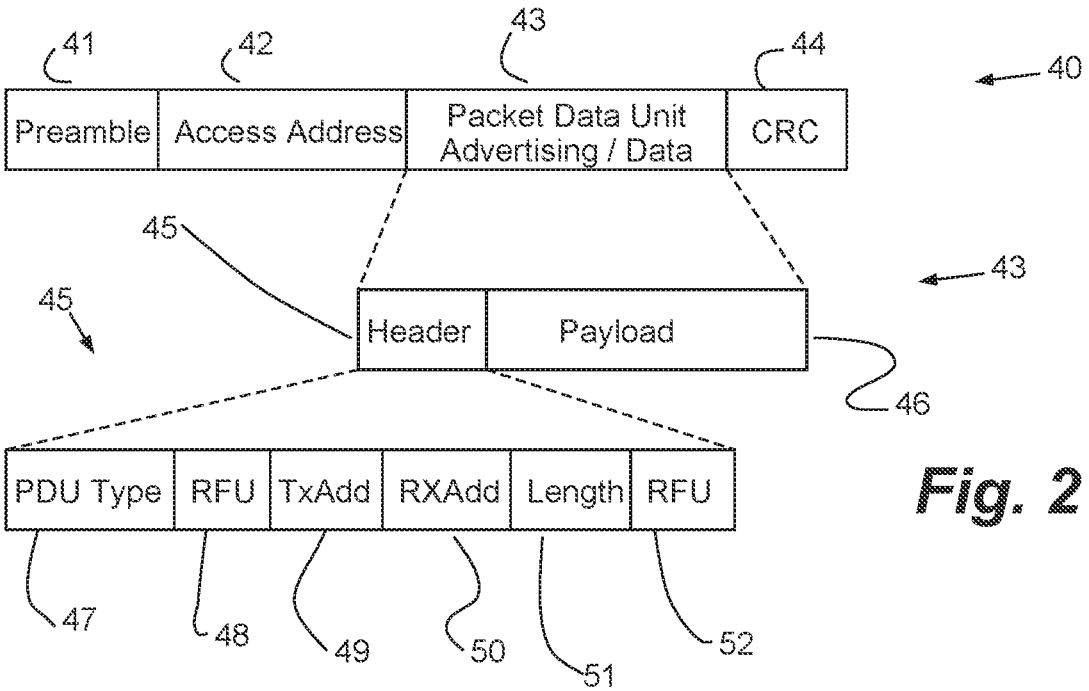
FIG. 2 illustrates the BLE link layer packet format for Bluetooth Low Energy.

FIG. 2 illustrates the BLE link layer (LL) packet format for Bluetooth Low Energy (BLE ver. 4.0). A BLE packet 40 includes a preamble 41 (one octet-8 bits) for synchronization, an access address 42 (four octets-32 bit) for physical link identification on every packet for receiving devices (slaves), a packet data unit (PDU) 43 of variable length, and a cyclic redundancy code (CRC, three octets-24 bit) 44. The packet data unit (PDU) 43 may vary from two to thirty-nine packets whereby significant power savings is obtained by omitting unnecessary information (already known by the receiving device). The cyclic redundancy code (CRC) 44 ensures correctness of the data in the PDU on all packets, thus increasing robustness against interference.

The packet data unit (PDU) 43 comprises a header 45 and a payload portion 46. The header 45 comprises 16 bits. A PDU type portion 47 includes four bits dedicated to define the PDU type. The PDU type portion 47 identifies the type of the payload, whether it relates to advertising data to be sent or whether it relates to data that have been advertised earlier. A TxAdd bit 49 indicates whether the advertiser address is public or random, and a RxAdd bit 50 indicates whether the initiator address is public or random. A length portion 51 identifies the payload length in bytes which e.g. may be up to 37 bytes. Two RFU portions 48 and 52 contain bits Reserved for Future Use (RFU).

Preferably, advertising information is contained in the data packet initiating an audio stream consisting of a plurality of data packets; and the advertising information characterizes the audio stream contained in the payload for the entire the data signal. The advertising information may characterize the audio stream as being utility audio and entertainment audio. However the advertising information may also characterize a data stream to be transmitted as being a control signal for remote control of the hearing assistive device or a programming signal for adjusting the settings of the hearing assistive device in a remote fitting process.

This remote device 30 may be the personal communication device, e.g. a smartphone, a dedicated music player, or a laptop computer, all operating in private domain (handshake between device and hearing aid), or a public communication device adapted for broadcasting an audio signal, e.g. in a cinema, a museum, an Internet hotspot, or a church, all in a public domain. A hotspot is a physical location that offers Internet access over a wireless local area network (WLAN) through the use of a router connected to a link to an Internet service provider. Hotspots typically use Wi-Fi technology.

According to one embodiment of the invention, the communication between the external audio signal source 30 and the hearing aid 10 is based on Bluetooth™. Bluetooth™ is a wireless technology standard for exchanging data over short distances using the ISM band from 2.4 to 2.485 GHz. Bluetooth™ is widely used for short range communication, for building personal area networks (PAN), and is employed in most mobile phones. Bluetooth™ Low Energy (BLE) has a fixed packet structure with only two types of packets; Advertising and Data. The key feature of the low-energy stack is a lightweight Link Layer (LL) that provides a power efficient idle mode operation (essential for hearing aids), simple device discovery and reliable point-to-multipoint data transfer with advanced power-save and encryption functionalities.

Figure 3:
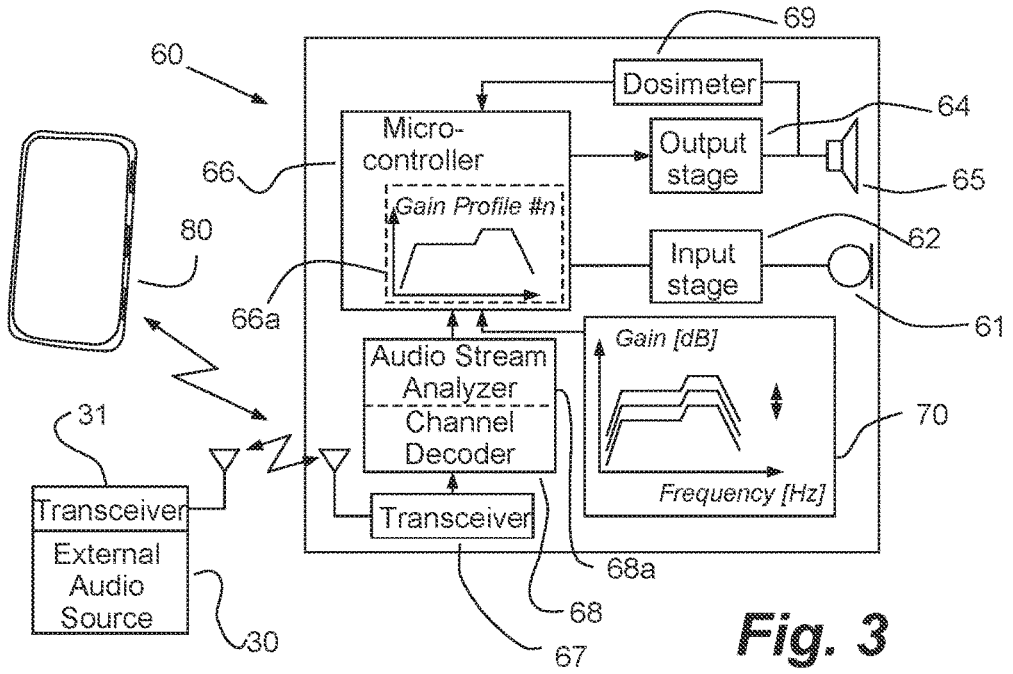
FIG. 3 illustrates schematically a second embodiment of a hearing assistive device according to the invention.

Reference is made to FIG. 3, which schematically illustrates a second embodiment of a hearing assistive device according to the invention. The hearing assistive device according to the embodiment shown in FIG. 3 is a Personal Sound Amplification Product (PSAP) 60. A PSAP 60 is an off-the-shelf amplifier for people with normal hearing needing a little boost in volume, typically at higher frequencies. PSAP's have grown in popularity among people with an insignificant hearing impairment, e.g. due to aging, as PSAP's are less expensive than custom hearing aids and are less stigmatizing as you do not have to schedule appointments with audiologists etc. PSAP's are often sold directly to the consumer through online stores, through drugstores and retail store chains, and at pharmacies.

The PSAP 60 comprises a microphone or input transducer 61 for picking up the acoustic sound and converting it into electric signals. The electric signals from the input transducer 61 are converted into a digital signal in an input stage 62. The digital signal is fed to a microcontroller 66 being a microprocessor a multipurpose, programmable device receiving digital data as input, which processes the data according to instructions stored in an associated memory 70, and provides resulting digital data as output. The output from the microcontroller 66 is fed to an output stage 64 driving an output transducer 65 or speaker.

The microcontroller 66 is a processing and control unit carrying out instructions of a computer program by performing the logical, basic arithmetic, control and input/output (I/O) operations specified by stored program instructions. The memory 70 is a non-volatile memory retaining stored information even when the PSAP is not powered. Furthermore, the PSAP 60 has a transceiver 67 for establishing a wireless connection to a smartphone 80 having a transceiver appropriate for communication with the PSAP 60. Hereby the smartphone 80 is able to stream audio from an ongoing telephone conversation as well as stream audio from its music player, and map the audio as being utility audio and entertainment audio, respectively. The external audio source according 30 has a transceiver 31 similar to what is explained with reference to FIG. 1.

The memory 70 comprises a library of Gain Profiles (indicated by three gain vs frequency curves) which is a collection of acoustic configuration settings for the PSAP 60, and one of these Gain Profiles **66*a* is used by the microcontroller 66 to shape the acoustic signal to be output to the output stage 64. Each of the Gain Profiles is based on the hearing characteristic of the user and is designed to compensate for the user's hearing loss. The microcontroller 66 serves as attenuator by applying another Gain Profile 66*a* for attenuating the compensated audio signal according to the accumulated sound level measured by the sound dosimeter 69**.

The hearing characteristic of the user may be tested by means of a private computer. A hearing loss might be inherited from parents or acquired from illness, ototoxic (ear-damaging) drugs, exposure to loud noise, tumors, head injury, or the aging process. However a mild and moderate hearing loss may be estimated by means of a simple questionnaire, as it has been recently understood that certain factors affect the hearing loss. These factors includes age, sex (men's hearing degrades faster than women's), birth weight (low birth weight causes faster degrading of hearing), and noise exposure (soldiers, hunters, musicians and people working in noisy environments do have a faster degrading of hearing). Other factors degrading the hearing includes smoking, exposure to radiation therapy and chemotherapy, extensive use of pain relievers and certain antibiotics, and diseases like diabetes and sleep apnea. The answers to a simple questionnaire show sufficiently good results for use as input for estimating an audiogram for Gain Profiles for PSAP 60.

The user downloads application software (app) from an app store via the Internet, and stores the app on a smartphone. The term "app" is short for application software, which is a set of one or more programs designed to carry out operations for a specific application. Application software cannot run on itself but is dependent on system software to execute. The app contains a simple questionnaire for estimating the hearing characteristic of the user, a control user interface (UI) for controlling the operation of the PSAP 60 from the smartphone, and streaming facilities enabling streaming of audio signals from the smartphone to the PSAP 60. When streaming audio, the smartphone 80 marks the audio signal in a way that the PSAP 60 is able to classify it as being utility audio or entertainment audio.

The PSAP 60 or the smartphone 80 includes a classifier for classifying an acoustic environment for selecting an appropriate Gain Profile. Alternatively the user may select the appropriate Gain Profile manually by means of the control UI of the smartphone 80. Each Gain Profile shapes or adjusts audio signals for a particular acoustic environment by suitable control of the transfer function of the sound processing of the microcontroller 66. A customized Gain Profile compensates for mild hearing deficits of the user. The compensating parameters include signal amplitude and gain characteristics. Furthermore, different signal processing algorithms may be applied, including settings of relevant coefficients.

The smartphone 80 operates in the same way as the external audio signal source 30 explained with reference to FIG. 1, and when the PSAP 60 receives an audio signal therefrom, the transceiver 67 converts the information carried in the radio signal to a usable data signal fed to a channel decoder 68. The channel decoder 68 includes audio stream analyzer 68*a* extracting advertising information contained in the data signal and classifies the payload of the data signal according to this extraction. Classes of received data signals may include utility audio signal, primary formed by audio from telephone calls and emergency alerts, and entertainment audio signal including streamed music from music players, soundtracks from streamed video, soundtracks from cinema movies and television broadcasts.

Furthermore, the data signal may contain hearing aid programming instructions as payload. PSAP programming includes two different aspects; acoustic programming referring to defining the library of Gain Profiles in the memory 70 which matches the hearing deficiency of the user and which becomes selectable by the user or by a classifier; and operational programming referring to settings which do not affect the sound significantly, such as volume control and selection of a specific Gain Profile. The programming type may be determined based on the advertising information contained in the data signal, and the classification of the received data signal is communicated to the processor 66.

In case the received data signal is classified as a utility audio signal by the audio stream analyzer 68*a*, the processor 66 passes the received audio signal on towards the output stage 64 by employing a Gain Profile with a transfer function as defined by means of the hearing characteristic determined for the user. In case the received data signal is classified as an entertainment audio signal by the audio stream analyzer 68*a*, the processor 66 passes the received audio signal on towards the output stage 64 by employing a Gain Profile with a transfer function with a lower gain (e.g. 3 dB) than what would otherwise be defined by means of the hearing characteristic determined for the user. If an entertainment audio signal has been streamed for some predetermined period (e.g. 1 hour), a new Gain Profile with an even lower gain (e.g. 3 dB) will be selected.

The attenuation ensures that the playing of entertainment audio signals does not adversely affect the hearing capabilities of the hearing aid user. The attenuation may be introduced in steps of e.g. 3 dB. The purpose for the attenuation is to ensure that the entertainment audio signal is attenuated to a level complying with the recommendations of the health authorities.

The purpose of a PSAP 60 is to amplify sounds and make them intelligible for the user, and the employment of Gain Profiles with lowered gain is to ensure that the user's hearing capabilities are not adversely affected due to long-term exposure to entertainment audio. For this purpose, a sound dosimeter 69 monitors the output from the speaker 65 in the user's ear channel. The sound dosimeter 69 monitors the accumulated exposure over time; the processor 66 compares the measured exposure to an exposure limit and the processor 66 selects a Gain Profile adapted to ensure that the measured exposure does not exceed the exposure limit. The processor 66 applies a 3 dB time-intensity tradeoff for long term exposure that may occur e.g. when watching television.

Figure 4:
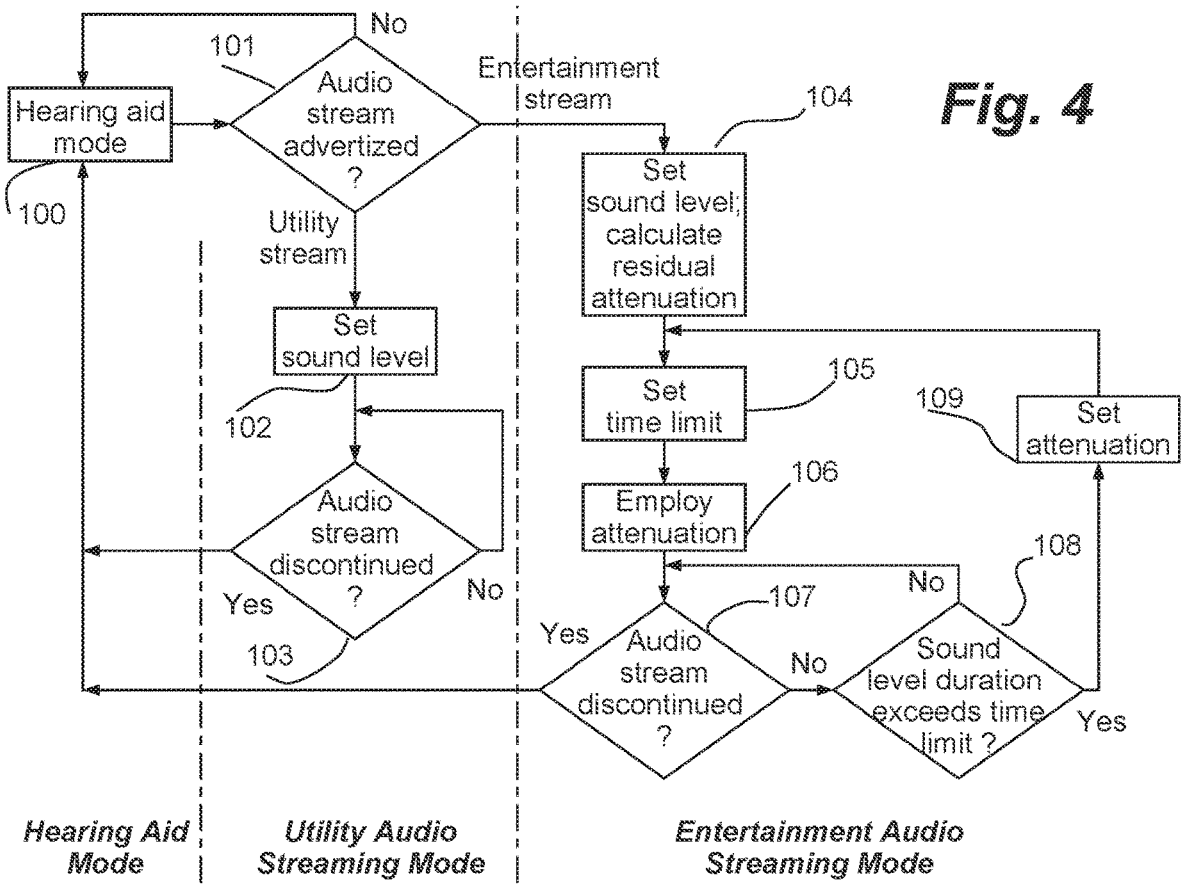
FIG. 4 illustrates that the hearing device may assume several modes.

FIG. 4 illustrates that the hearing device, here the hearing aid 10, may assume several modes. Three modes are illustrated including a first normal hearing aid mode, a second utility audio streaming mode and a third entertainment audio streaming mode.

In the first normal hearing aid mode, the microphone 12 converts sound into an electric signal, the processor 14 processes the converted microphone signal suitable to alleviate the hearing loss of the user, and the amplified signal is output via the speaker 16. The hearing loss alleviation takes place according to the settings set by the hearing care professional. The hearing aid 10 stays in the hearing aid mode, illustrated by step 100, as long as no audio stream has been advertised in step 101.

In case an audio stream has been advertised in step 101, and the audio stream has been classified as a utility audio stream, the hearing aid 10 enters the utility audio streaming mode. Utility audio includes real time audio from a telephone conversation or other types of predetermined, streamed, high priority audio, as alerts and alarms. When entering the utility audio streaming mode, in step 102 the processor 17 sets the sound level for the audio reproduction of the streamed audio according to the settings set by the hearing care professional. The sound level for the audio reproduction remains at the set level until the audio stream in step 103 is detected as being discontinued, or until the hearing aid user adjusts the reproduction volume manually. When the discontinuation has been detected in step 103, the hearing aid 10 reverts to normal hearing aid mode.

In case an audio stream has been advertised in step 101, and the audio stream has been classified as an entertainment audio stream, the hearing aid 10 enters the entertainment audio streaming mode. Entertainment audio includes streamed, broadcasted audio as radio and television sound, and soundtracks from movies and Internet streamed video. When entering the entertainment audio streaming mode, in step 104 the processor 17 sets the sound level for the audio reproduction of the streamed audio according to the settings set by the hearing care professional. In one embodiment, the sound level set in step 104 is lower, e.g. by up to 5 dB, than the sound level set in step 102. In step 105, the processor 17 sets the time limit for the present sound level of the reproduced audio streamed audio according to the settings set by the hearing care professional. Preferably the time limit follows the recommendations set by health authorities like OSHA and NIOSH. If the hearing aid 10 has been in the entertainment audio streaming mode recently, an initial attenuation is calculated for the new entertainment audio streaming mode session based on the attenuation employed in the previous entertainment audio streaming mode session and the time elapsed. Hereby the user's ability to recover for noisy audio streaming is taken into account.

The resulting sound level output to the hearing aid user will in step 106 be calculated to be the sound level set in step 104 reduced by the applied attenuation. Initially the attenuation will be 0 dB if the hearing aid 10 has not recently been in the entertainment audio streaming mode; otherwise the initial attenuation calculated in step 104 will be applied.

Hereafter the streaming conditions remain stable in a loop structure of the process flow. In step 107, it is detected whether the audio stream has been discontinued, and if this is the case the hearing aid 10 reverts to normal hearing aid mode at step 100. However if the audio stream has not been discontinued, the processor 17 checks in step 108 whether the present sound level has had a duration exceeding the time limit set in step 105. If this is not the case the loop structure is continued. If the time limit has been exceeded, a new attenuation value is set at step 109 where the current value is increased by a predetermined increment, e.g. 3 dB.

Hereafter, the processor 17 sets in step 105 the time limit for the new sound level of the reproduced audio streamed audio. The new sound level output to the hearing aid user will in step 106 be calculated to be the recent sound level reduced by the attenuation set in step 109. Then the loop structure of step 107 and step 108 continues until the audio stream has been discontinued, or until the duration of audio at the present sound level has exceeded the time limit set.

What is claimed is:

1. A hearing assistive device having an input transducer adapted for converting sound into an audio signal, a processor receiving said audio signal and configured to compensate a hearing loss of a user of the hearing assistive device and to output a compensated audio signal, and an output transducer adapted for converting the compensated audio signal into sound, and further comprising:

a wireless transceiver enabling audio streaming from an external device to the hearing assistive device;

a sound dosimeter measuring during audio streaming a parameter representative of a sound exposure of the compensated audio signal output by the output transducer; and a controllable attenuator associated with said processor adapted for applying attenuation to the compensated audio signal;

wherein the attenuator is controlled according to the parameter measured by the sound dosimeter only during said audio streaming from said external device.

2. The hearing assistive device according to claim 1, wherein the processor is adapted to alleviate a hearing loss of a hearing assistive device user by amplifying sound at frequencies in those parts of the audible frequency range where the user suffers a hearing deficit.

3. The hearing assistive device according to claim 1 wherein the sound dosimeter is enabled only during said audio streaming from said external device.

4. The hearing assistive device according to claim 3 and further comprising an audio stream analyzer classifying the audio stream received via said wireless transceiver as utility audio or entertainment audio, wherein the sound dosimeter is enabled when said audio stream is classified as entertainment audio.

5. The hearing assistive device according to claim 4, wherein audio stream is received by said wireless transceiver as packet data, and based upon the header of the data packets, the audio stream analyzer classifies the data stream as utility audio or entertainment audio.

6. The hearing assistive device according to claim 4, wherein the attenuator applies attenuation to the received audio stream when classified as entertainment audio.

7. The hearing assistive device according to claim 1, wherein the output from the sound dosimeter is compared with one or more predefined thresholds, and the attenuation applied to the compensated audio signal depends on the comparison.

8. A method of operating a hearing assistive device having an input transducer converting sound into an audio signal applied to a processor, said processor being configured to compensate a hearing loss of a user of the hearing assistive device and to output a compensated audio signal, and an output transducer converting the compensated audio signal into sound, said method comprising:

receiving an audio stream from an external device;

measuring during audio streaming a parameter representing a dosage of sound output by the output transducer;

applying attenuation to the compensated audio signal; and controlling said attenuation according to the measured parameter measured only during audio streaming from said external device.

9. The method according to claim 8, comprising enabling of the measuring of the parameter representative for the sound dosage output by the output transducer only during said audio stream reception.

10. The method according to claim 9, further comprising classifying the received audio stream as utility audio or entertainment audio, and enabling the measuring of the sound level accumulated over time when said audio stream is classified as entertainment audio.

11. The method according to claim 10, comprising receiving the audio stream as packet data, and classifying the audio stream as utility audio or entertainment audio based upon the header of the data packets.

12. The method according to claim 10, comprising applying attenuation to the received audio stream when classified as entertainment audio.

13. The method according to claim 10, comprising comparing the sound dosage to one or more predefined thresholds, and applying attenuation to the compensated audio signal in dependence of the comparison.

* * * * *